US006753134B2

(12) United States Patent
Hasberg et al.

(10) Patent No.: US 6,753,134 B2
(45) Date of Patent: Jun. 22, 2004

(54) PROCESS FOR THE PREPARATION OF HIGH BROMIDE CUBIC GRAIN EMULSIONS

(75) Inventors: Dirk J. Hasberg, Rochester, NY (US); Rajesh V. Mehta, Rochester, NY (US); Ralph W. Jones, Jr, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/202,314

(22) Filed: Jul. 24, 2002

(65) Prior Publication Data

US 2004/0018456 A1 Jan. 29, 2004

(51) Int. Cl.[7] ..... G03C 1/035
(52) U.S. Cl. ..... 430/569; 430/567
(58) Field of Search ..... 430/569; 1/567

(56) References Cited

U.S. PATENT DOCUMENTS

| | | | | |
|---|---|---|---|---|
| 4,067,739 A | | 1/1978 | Lewis | 430/567 |
| 4,301,241 A | | 11/1981 | Saito | 430/569 |
| 4,539,290 A | | 9/1985 | Mumaw | 430/569 |
| 4,666,669 A | | 5/1987 | Mumaw | 422/116 |
| 5,089,379 A | | 2/1992 | Yatsuyanagi | 430/434 |
| 5,104,782 A | | 4/1992 | Ichikawa et al. | 430/569 |
| 5,549,879 A | | 8/1996 | Chow | 423/491 |
| 5,807,666 A | | 9/1998 | Adin et al. | 430/581 |
| 5,840,473 A | * | 11/1998 | Mydlarz et al. | 430/509 |
| 5,849,470 A | * | 12/1998 | Mydlarz et al. | 430/509 |
| 5,985,535 A | | 11/1999 | Urabe | 430/569 |
| 6,043,019 A | | 3/2000 | Jagannathan et al. | 430/569 |
| 6,048,683 A | | 4/2000 | Mehta et al. | 430/569 |
| 6,136,523 A | | 10/2000 | Jezequel et al. | 430/569 |
| 6,265,145 B1 | | 7/2001 | Mehta et al. | 430/569 |

OTHER PUBLICATIONS

Copending, commonly assigned USSN 10/157,689 (Docket 84082).

* cited by examiner

*Primary Examiner*—Hoa Van Le
(74) *Attorney, Agent, or Firm*—Andrew J. Anderson

(57) ABSTRACT

A process for the preparation of a radiation-sensitive silver halide emulsion comprised of high bromide cubical silver halide grains is described, the process comprising: (a) providing in a stirred reaction vessel a dispersing medium and high bromide silver halide seed grains, the seed grains comprising at least 5 mole % of the final emulsion silver, and (b) precipitating a silver halide shell which comprises at least 5 mole % of the final emulsion silver onto the seed grains by introducing at least a silver salt solution into the dispersing medium at a rate such that the normalized shell molar addition rate, $R_s$, is above $1.0\times10^{-3}$ $min^{-2}$, $R_s$ satisfying the formula:

$$R_s = \frac{M_s}{M_t t_s^2}$$

where $M_s$ is the number of moles of silver halides added to the reaction vessel during the formation of the shell, $t_s$ is the run time, in minutes, of the silver salt solution for the formation of the shell, and $M_t$ is total moles of silver halide in the reaction vessel at the end of the precipitation of the shell; wherein the concentration of silver halide grains in the reaction vessel at the end of the precipitation of the shell is at least 0.5 mole/L. The invention provides an improved manufacturing process for the preparation of high bromide silver halide cubical grain emulsion enabling concentrated emulsion batches to be prepared with desired photographic properties. In certain embodiments of the invention, further advantages are enabled in accordance with the discovery that when the exterior portion of high bromide silver halide cubic grains are grown under specific conditions of high molar addition rates, emulsions of enhanced sensitivity, improved contrast and radiographic curve shape may be produced while controlling the minimum fog level.

20 Claims, No Drawings

PROCESS FOR THE PREPARATION OF HIGH BROMIDE CUBIC GRAIN EMULSIONS

FIELD OF THE INVENTION

This invention is directed to the preparation of radiation sensitive high bromide silver halide photographic emulsions, including emulsions useful in electronic printing methods wherein information is recorded in a pixel-by-pixel mode in a radiation sensitive silver halide emulsion layer. It particularly relates to the preparation of the exterior portions of silver halide emulsion grains after formation of a core.

DEFINITION OF TERMS

In referring to grains and emulsions containing two or more halides, the halides are named in order of ascending concentrations.

The term "high bromide" and "high chloride" in referring to silver halide grains and emulsions indicate greater than 50 mole percent bromide or chloride, respectively, based on total silver.

The term "equivalent circular diameter" or "ECD" indicates the diameter of a circle having an area equal to the projected area of a grain or particle.

The term "size" in referring to grains and particles, unless otherwise described, indicates ECD.

The term "regular grain" refers to a silver halide grain that is internally free of stacking faults, which include twin planes and screw dislocations.

The term "cubic grain" is employed to indicate a regular grain is that bounded by six {100} crystal faces. Typically the corners and edges of the grains show some rounding due to ripening, but no identifiable crystal faces other than the six {100} crystal faces. The six {100} crystal faces form three pairs of parallel {100} crystal faces that are equidistantly spaced.

The term "cubical grain" is employed to indicate grains that are at least in part bounded by {100} crystal faces satisfying the relative orientation and spacing of cubic grains. That is, three pairs of parallel {100} crystal faces are equidistantly spaced. Cubical grains include both cubic grains and grains that have one or more additional identifiable crystal faces. For example, tetradecahedral grains having six {100} and eight {111} crystal faces are a common form of cubical grains.

The term "roundness coefficient" (hereinafter assigned the symbol "n") and the term "roundness index" (hereinafter assigned the symbol "Q") are measures of the degree to which silver halide grain corners are rounded as defined by Mehta et al. in U.S. Pat. No. 6,048,683. "n" is chosen to satisfy the formula $x^n+y^n=R^n$, where R is any vector extending from the center of a {100} crystal face of a grain to the projected peripheral edge of the grain viewed normal to the {100} crystal face, x is an X axis coordinate of R, y is a Y axis coordinate of R, and X and Y are mutually perpendicular axes in the plane of the {100} crystal face. For a circle, the roundness coefficient is 2, while for a square the roundness coefficient is increased to infinity. For convenience, roundness index Q is defined as being equal to 2/n. Thus, the Q of a square is zero, while that for a circle is 1. The degree to which regular silver halide grains having {100} crystal faces exhibit corner rounding is determined by looking at the projected area of a grain in a photomicrograph viewed normal to a {100} crystal face. The value of n that most closely matches the peripheral boundery of the {100} grain face is the roundness coefficient of the grain. From measurement of a representative number of grains, an average roundness coefficient n and roundness index Q can be determined for an emulsion.

The term "central portion" or "core" in referring to silver halide grains refers to an interior portion of the grain structure that is first precipitated relative to a later precipitated portion.

The term "shell" in referring to silver halide grains refers to an exterior portion of the silver halide grain which is precipitated on a central portion.

The term "dopant" is employed to indicate any material within the rock salt face centered cubic crystal lattice structure of a silver halide grain other than silver ion or halide ion.

The term "dopant band" is employed to indicate the portion of the grain formed during the time that dopant was introduced to the grain during precipitation process.

The term "normalized shell molar addition rate", hereinafter assigned the symbol $R_s$, is a measure of the intensity of rate of addition of silver salt solution to a reaction vessel during formation of a shell. $R_s$ is defined by the formula:

$$R_s = \frac{M_s}{M_t t_s^2}$$

where $M_s$ is the number of moles of silver halides added to the reaction vessel during the formation of the shell, $t_s$ is the run time, in minutes, of the silver salt solution for the formation of the shell, and $M_t$ is total moles of silver halides in the reaction vessel at the end of the precipitation.

The term "log E" is the logarithm of exposure in lux-seconds.

Photographic speed is reported in relative log units and therefore referred to as relative log speed. 1.0 relative log speed unit is equal to 0.01 log E.

The term "contrast" or "γ" is employed to indicate the slope of a line drawn from stated density points on the characteristic curve.

The term "rapid access processing" and "rapid access processor" are employed to indicate the capability of providing dry-to-dry processing in 90 seconds or less. The term "dry-to-dry" is used to indicate the processing cycle that occurs between the time a dry, imagewise exposed element enters a processor to the time it emerges, developed, fixed and dry

*Research Disclosure* is published by Kenneth Mason Publications, Ltd., Dudley House, 12 North St., Emsworth, Hampshire P010 7DQ, England.

BACKGROUND OF THE INVENTION

Double-jet precipitation is a common practice in the making of silver halide emulsions. Silver salt solution and halide salt solution are introduced simultaneously, but separately, into a precipitation reactor under mixing. In order to achieve desired crystal characteristics, typically, the silver ion activity or the halide ion activity is controlled during the precipitation by adjusting the feed rates of the salt solutions using either a silver ion sensor or a halide ion sensor.

Formation of silver halide emulsions typically involves a crystal nuclei-forming step wherein addition of silver ion results primarily in the precipitation of new crystal nuclei, and a subsequent double-jet growth step wherein the rate at which silver and halide are introduced is controlled to primarily grow the crystals already previously formed while avoiding the formation of new seed grains, i.e., renucleation. Addition rate control to avoid renucleation, and thereby generally provide for a more monodisperse grain size final grain population, is generally well known in the art, as illustrated by Wilgus German OLS No. 2,107,118; Irie U.S. Pat. No. 3,650,757; Kurz U.S. Pat. No. 3,672,900; Saito U.S. Pat. No. 4,242,445; Teitschied et al European Patent Application 80102242; "Growth Mechanism of AgBr Crystals in Gelatin Solution", Photographic Science and Engineering, Vol. 21, No. 1, January/February 1977, p. 14, et seq. The term "critical crystal growth rate" is used in the art to describe the growth rate obtained at the maximum rate of silver ion and halide ion addition which does not produce renucleation. While maintaining silver and halide addition rates below that which form new grain populations is advantageous during grain growth in terms of controlling the emulsion grain population characteristics, it also can restrict obtainable emulsion concentrations (i.e., batch yields) and lengthen emulsion manufacturing times.

U.S. Pat. Nos. 5,549,879; 6,043,019; 6,048,683 and 6,265,145 disclose double jet techniques for preparing silver halide grains wherein silver and halide salt solutions are added at a "pulsed flow" rate designed to generate a second grain population (i.e., at a rate above that which would provide for the critical crystal growth rate), with multiple short "pulses" being separated by hold periods designed to allow the new grain population to be ripened out. U.S. Pat. No. 5,549,879, e.g., discloses introducing an aqueous silver nitrate solution from a remote source by a conduit which terminates close to an adjacent inlet zone of a mixing device, which is disclosed in greater detail in *Research Disclosure*, Vol. 382, February 1996, Item 38213. Simultaneously with the introduction of the aqueous silver nitrate solution and in an opposing direction, aqueous halide solution is introduced from a remote source by a conduit which terminates close to an adjacent inlet zone of the mixing device. The mixing device is vertically disposed in a reaction vessel and attached to the end of a shaft, driven at high speed by any suitable means. The lower end of the rotating mixing device is spaced up from the bottom of the vessel, but beneath the surface of the aqueous silver halide emulsion contained within the vessel. Baffles, sufficient in number to inhibit horizontal rotation of the contents of the vessel are located around the mixing device. The described apparatus is operated in a "pulse flow" manner comprising the steps of: (a) providing an aqueous solution containing silver halide particles having a first grain size; (b) continuously mixing the aqueous solution containing silver halide particles; (c) simultaneously introducing a soluble silver salt solution and a soluble halide salt solution into a reaction vessel of high velocity turbulent flow confined within the aqueous solution for a time t, wherein high is at least 1000 rpm; (d) simultaneously halting the introduction of the soluble silver salt solution and the soluble halide salt solution into the reaction for a time T wherein T>t, thereby allowing the silver halide particles to grow; and (e) repeating steps (c) and (d) until the silver halide particles attain a second grain size greater than the first grain size. Advantages of the pulse flow technique described include permitting easier scalability of the precipitation method. There is no disclosure of use of such pulse flow technique to enable larger emulsion concentrations (i.e., batch yields) or shorten emulsion manufacturing times. To the contrary, the disclosed need for relatively long hold times between pulsed addition of silver and halide salts can result in longer manufacturing times.

Jagannathan et al. U.S. Pat. No. 6,043,019 teaches the use of pulsed flow growth for high bromide tabular grain emulsion after a speed-enhancing amount of iodide is added to the reaction vessel. Such emulsions are more robust for chemical sensitization, have an improved speed-granularity relationship and they exhibit reduced intrinsic fog. Thus, pulsed growth appears to affect iodide incorporation in tabular grains in a beneficial way. There is no disclosure of use of such pulse flow technique to enable preparation of high bromide emulsion grains having desired performance characteristics while increasing emulsion concentrations (i.e., batch yields) or shorten emulsion manufacturing times. To the contrary, the pulsed addition of silver halide salts is described specifically for only the outer 5 to 50 percent (and more preferably for only the outer 5 to 30 percent) of silver forming the final tabular grain emulsion, and the pulses are separated by hold times. Further, there is no disclosure of use of the described process to prepare high bromide cubical emulsion grains.

Mehta et al. U.S. Pat. No. 6,048,683 teaches a pulse flow process for the preparation of high chloride cubical silver halide grains grown in the presence of a thioether ripening agent wherein the resulting silver chloride grains exhibit an average grain roundness coefficient, n, in the range of from 2 to less than 15. Mehta et al. U.S. Pat. No. 6,265,145 teaches a process for the preparation of high chloride cubical silver halide grains containing from 0.05 to 3 mole percent iodide where iodide is incorporated in the grains by introducing at least a silver salt solution into the dispersing medium at a rate such that the normalizing molar addition rate $R_n$ is above $5\times10^{-2}$ $min^{-1}$ where $R_n$ satisfies the formula $$R_n = \frac{Q_f C_f}{M}$$

where $Q_f$ is the volumetric rate of addition, in liters/min, of silver salt solution to the reaction vessel, $C_f$ is the concentration, in moles/liter, of the silver salt solution, and M is the total moles of silver halide in the host grains in the reaction vessel at the precise moment of addition of the silver salt solution. There is no disclosure, however, of use of the above processes to prepare high bromide silver halide cubical grain emulsions.

SUMMARY OF THE INVENTION

In one aspect, this invention is directed to a process for the preparation of a radiation-sensitive silver halide emulsion comprised of high bromide cubical silver halide grains, the process comprising: (a) providing in a stirred reaction vessel a dispersing medium and high bromide silver halide seed grains, the seed grains comprising at least 5 mole % of the final emulsion silver, and (b) precipitating a silver halide shell which comprises at least 5 mole % of the final emulsion silver onto the seed grains by introducing at least a silver salt solution into the dispersing medium at a rate such that the normalized shell molar addition rate, $R_s$, is above $1.0\times10^{-3}$ $min^{-2}$, $R_s$ satisfying the formula:

$$R_s = \frac{M_s}{M_t t_s^2}$$

where $M_s$ is the number of moles of silver halides added to the reaction vessel during the formation of the shell, $t_s$ is the run time, in minutes, of the silver salt solution for the formation of the shell, and $M_t$ is total moles of silver halide in the reaction vessel at the end of the precipitation of the shell; wherein the concentration of silver halide grains in the reaction vessel at the end of the precipitation of the shell is at least 0.5 mole/L.

In another aspect, this invention is directed towards a high bromide cubic silver halide grain emulsion prepared in accordance with the above process, wherein the silver halide grains of the emulsion have an average cubic edge length of less than 0.4 micrometers and an average roundness index Q of less than 0.35.

In further aspects, this invention is directed towards a photographic element, and especially a radiographic recording element, comprising a support and at least one light sensitive silver halide emulsion layer comprising silver halide grains prepared as described above.

The invention provides an improved manufacturing process for the preparation of high bromide silver halide cubical grain emulsion enabling concentrated emulsion batches to be prepared with desired photographic properties. In certain embodiments of the invention, further advantages are enabled in accordance with the discovery that when the exterior portion of high bromide silver halide cubic grains are grown under specific conditions of high molar addition rates, emulsions of enhanced sensitivity, improved contrast and radiographic curve shape may be produced while controlling the minimum fog level.

DESCRIPTION OF PREFERRED EMBODIMENTS

High bromide cubical silver halide grains precipitated in accordance with the invention contain greater than 50 mole percent bromide, based on silver. Preferably the grains contain at least 70 mole percent bromide and, optimally at least 90 mole percent bromide, based on silver. The balance of the halide not accounted for by bromide can be chloride and/or iodide. Silver bromide and silver chloride are miscible in all proportions; hence, any portion of the total halide not accounted for bromide, can be chloride. While chloride ions may be incorporated in high bromide grain emulsions at high levels, in order to maintain sensitivity advantages associated with high bromide emulsion versus high chloride emulsions, chloride inclusions are preferably limited to up to 5 mole percent, based on silver. Incorporation of iodide into high bromide grains is limited by iodide solubility levels (e.g., approx. 40 mole % iodide in silver iodobromide grains). Iodide even at relatively low levels (e.g., 0.25 to 10 mole percent), however, is well know in the art to provide increases in speed and other effects. The method of the invention can be employed to prepare high bromide cubical grain emulsions of any conventional mean grain size known to be useful in photographic elements. Mean grain sizes in the range of from 0.15 to 2.5 $\mu$m are typical, with mean grain sizes of less than 2 $\mu$m, and more preferably less than 1 $\mu$m, generally being preferred to provide improved granularity results in photographic elements employing such emulsions.

The method of the invention can be viewed as a modification of conventional methods for preparing high bromide cubical grain emulsions, wherein after formation of a host grain emulsion grain population a substantial portion of total silver of the emulsion (i.e., at least 5 mole percent, preferably at least 10 mole percent, more preferably at least 20 mole percent, at least 30 mole percent, or at least 40 mole percent, even more preferably greater than 50 mole percent, and most preferably at least 60 mole percent) is added to the reaction vessel in the form of a silver salt solution at a relatively high normalized shell molar addition rate. Any convenient conventional silver halide seed or host grain precipitation procedure may be employed to form the host grain population, which in accordance with the invention accounts for at least 5 mole percent (preferably at least 10 mole percent, more preferably at least 15 mole percent) of total silver of the final emulsion to be formed. The host grain emulsions can have any halide concentrations consistent with the general halide requirement for high bromide grains. While levels of iodide and/or chloride consistent with the overall composition requirements of the grains can be included within the host grains, in one specifically contemplated preferred form the host seed grain emulsion is an essentially pure silver bromide cubical grain emulsion. The host grains are preferably cubic, but can include other cubical forms, such as tetradecahedral forms. Techniques for forming emulsions satisfying the host grain requirements of the preparation process are well known in the art. The rate at which silver nitrate and sodium bromide (or other silver and halide sources) are added into the reactor during precipitation of the host grains can be at any practical molar addition rate. The initially formed seed grains then serve as hosts for further grain growth. While the host grains prepared by conventional methods may form from 5 to 95 mole percent of the final emulsion, it is preferred that the host grains account for at least 10 percent and up to 80 percent, and more preferably at least 15 percent and less than 50 percent, of total silver forming the emulsions produced by the invention.

Once a host grain population has been prepared which will account for at least 5 mole percent (preferably at least 10 percent, and more preferably at least 15 percent) of total silver of the final emulsion, silver salt solution is added at a high normalized shell molar addition rate (i.e., $R_s$ greater than $1.0\times10^{-3}$ $min^{-2}$, preferably greater than or equal to $2.0\times10^{-3}$ $min^{-2}$) in accordance with the invention to create an outer shell comprising at least 5 mole percent (preferably at least 10 percent, more preferably at least 20 percent, and most preferably greater than 50 mole percent) of total silver of the final emulsion. Where the reaction vessel contains excess halide ions, the silver salt solution may be added by itself to precipitate the outer shell. It is preferred, however, to simultaneously introduce a halide salt solution into the dispersing medium with the silver salt solution. Bromide salt may be added as the halide salt, either alone or in combination with chloride or iodide salts consistent with the overall composition requirements of the grains to be formed. The concentration of silver halide grains in the reaction vessel at the end of the precipitation of the shell is at least 0.5 mole/L, preferably at least 0.8 mole/L and more preferably at least 1.0 mole/L.

At the conclusion of grain precipitation the grains can take varied cubical forms, ranging from cubic grains (bounded entirely by six {100} crystal faces), grains having an occasional identifiable {111} face in addition to six {100} crystal faces, and, at the opposite extreme tetradecahedral grains having six {100} and eight {111} crystal faces. Formation of cubic grains during grain growth, e.g., may be favored by controlling the relative silver and halide ion solution concentrations as well known in the art (e.g., maintaining pAg at 8.10 or less, preferably 7.80 or less and more preferably 7.60 or less). In accordance with a particular embodiment, the method of the invention has surprisingly been found to improve the "cubicity" of cubic emulsion grains, especially for finer grain emulsions, as demonstrated by the preparation of emulsions comprising cubic grains having a lower average roundness index. The method of the invention is thus preferably employed to prepare high bromide cubic grain emulsions comprising grains having an average cubic edge length of less than 0.4 micrometers (more preferably less than or equal to 0.35 micrometers and most preferably less than or equal to 0.33 micrometers) and an average roundness index Q of less than 0.35 (more preferably less than or equal to 0.32 and most preferably less than or equal to 0.30). Such high cubicity grain emulsions have been found to provide improvements with respect to higher contrast, lower fog, and higher maximum densities when employed in photographic elements, particularly for radiographic photographic elements designed for rapid access processing.

It is surprising that the grains comprising shells formed using high rates of reagents addition as required in accordance with the invention not only contribute to a more productive manufacturing process, but are also compatible with achieving higher levels of photosensitivity. After examining the performance of emulsions exhibiting varied cubical grain shapes, it has been concluded that the performance of the improved cubicity emulsions obtained in accordance with preferred embodiments of the invention is principally determined by an improvement in the uniformity of grain size dispersity and cubicity enabled by the process of the invention, relative to emulsions prepared at conventional rates of reagent addition. The high bromide cubical silver halide grains prepared in accordance with the invention preferably exhibit a grain size coefficient of variation of less than 35 percent and optimally less than 25 percent. Much lower grain size coefficients of variation can be realized, but progressively smaller incremental advantages are realized as dispersity is minimized.

The normalized shell molar addition rate in accordance with the invention is substantially higher than critical crystal growth rates typically determined in accordance with prior art techniques. While reagent addition rates only slightly greater than that which would be associated with such conventionally determined critical crystal growth rates are believed to simultaneously result in both renucleation and growth of the pre-existing seeds as well as the renucleated seeds, and thus a decrease in grain size uniformity (i.e., increase in polydispersity), it has been surprisingly found that where the normalized shell molar addition rate is further increased to levels in accordance with the invention substantially all of the added reagent is precipitated into fine grains which then ripen primarily only onto the larger pre-existing seed or host grains, resulting a relatively monodisperse emulsion.

In the simplest form of silver halide grain preparation in accordance with the invention, nucleation and growth stages may occur in the same reaction vessel. Two or more separate reaction vessels can be substituted for the single reaction vessel, however. Nucleation and initial growth of seed grains can be performed in an upstream reaction vessel, e.g., and the dispersed grain nuclei can be transferred to a downstream reaction vessel in which the subsequent shell growth step occurs. Arrangements which separate grain nucleation from grain growth, e.g., are disclosed by Mignot U.S. Pat. No. 4,334,012 (which also discloses the useful feature of ultrafiltration during grain growth); Urabe U.S. Pat. No. 4,879,208 and published European Patent Applications 326,852; 326,853; 355,535 and 370,116, Ichizo published European Patent Application 0 368 275; Urabe et al published European Patent Application 0 374 954; and Onishi et al published Japanese Patent Application (Kokai) 172,817-A (1990).

It is specifically contemplated to incorporate dopants into the silver halide emulsion grains of the invention during precipitation. The use of dopants in silver halide grains to modify photographic performance is generally illustrated by *Research Disclosure*, Item 38957, cited above, I. Emulsion grains and their preparation, D. Grain modifying conditions and adjustments, paragraphs (3)–(5). Photographic performance attributes known to be affected by dopants include sensitivity, reciprocity failure, and contrast.

Once high bromide cubical grains have been precipitated as described above, chemical and spectral sensitization, followed by the addition of conventional addenda to adapt the emulsion for the imaging application of choice can take any convenient conventional form. These conventional features are illustrated by *Research Disclosure*, Item 38957, cited above, particularly:

III. Emulsion washing;

IV. Chemical sensitization;

V. Spectral sensitization and desensitization;

VII. Antifoggants and stabilizers;

VIII. Absorbing and scattering materials;

IX. Coating and physical property modifying addenda; and

X. Dye image formers and modifiers.

Some additional silver halide, generally less than 5 percent and typically less than 1 percent, based on total silver, can be introduced to facilitate chemical sensitization. It is also recognized that silver halide can be epitaxially deposited at selected sites on a host grain to increase its sensitivity. For the purpose of providing a clear demarcation, the term "silver halide grain" is herein employed to include the silver necessary to form the grain up to the point that the final major {100} crystal faces of the grain are formed. Silver halide later deposited that does not overlie the major crystal faces previously formed accounting for at least 50 percent of the grain surface area is excluded in determining total silver forming the silver halide grains. Thus, silver forming selected site epitaxy is not part of the silver halide grains while silver halide that deposits and provides the final major crystal faces of the grains is included in the total silver forming the grains, even when it differs significantly in composition from the previously precipitated silver halide.

The emulsions of the invention may be chemically sensitized as known in the art. Preferred chemical sensitizers include gold and sulfur chemical sensitizers. Typical of suitable gold and sulfur sensitizers are those set forth in Section IV of *Research Disclosure* 38957, September 1996. Preferred is colloid aurous sulfide such as disclosed in *Research Disclosure* 37154 for good speed and low fog. It is also possible to add dopants during emulsion finishing.

The emulsions can be spectrally sensitized in any convenient conventional manner. Spectral sensitization and the selection of spectral sensitizing dyes is disclosed, for example, in *Research Disclosure*, Item 38957, cited above, Section V. Spectral sensitization and desensitization. The emulsions used in the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines. Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

The silver bromide emulsions are preferably protected against changes in fog upon aging. Preferred antifoggants can be selected from among the following groups:

A. A mercapto heterocyclic nitrogen compound containing a mercapto group bonded to a carbon atom which is linked to an adjacent nitrogen atom in a heterocyclic ring system, B. A quaternary aromatic chalcogenazolium salt wherein the chalcogen is sulfur, selenium or tellurium, C. A triazole or tetrazole containing an ionizable hydrogen bonded to a nitrogen atom in a heterocyclic ring system, or D. A dichalcogenide compound comprising an -X-X- linkage between carbon atoms wherein each X is divalent sulfur, selenium or tellurium.

The above groups of antifoggants are known in the art, and are described in more detail, e.g., in U.S. Pat. No. 5,792,601, the disclosure of which is incorporated by reference herein.

In the simplest contemplated form a recording element in accordance with the invention can consist of a single emulsion layer satisfying the emulsion description provided above coated on a conventional radiographic support, such as those described in *Research Disclosure*, Item 38957, cited above, XVI. Supports. With a single emulsion layer unit a monochromatic image is obtained. It is, of course, recognized that the elements of the invention can include more than one emulsion. Where more than one emulsion is employed, such as in an element containing a blended emulsion layer or separate emulsion layer units, all of the emulsions can be high bromide silver halide emulsions prepared as contemplated by this invention. Alternatively one or more conventionally prepared emulsions can be employed in combination with the emulsions of this invention. For example, a separate emulsion, such as a silver chloride or bromochloride emulsion, can be blended with an emulsion prepared according to the invention to satisfy specific imaging requirements. For example, emulsions of differing speed are conventionally blended to attain specific aim radiographic characteristics. Instead of blending emulsions, the same effect can usually be obtained by coating the emulsions that might be blended in separate layers. It is well known in the art that increased radiographic speed can be realized when faster and slower emulsions are coated in separate layers with the faster emulsion layer positioned to receiving exposing radiation first. When the slower emulsion layer is coated to receive exposing radiation first, the result is a higher contrast image. Specific illustrations are provided by *Research Disclosure*, Item 36544, cited above Section I. Emulsion grains and their preparation, Subsection E. Blends, layers and performance categories.

The emulsion layers as well as optional additional layers, such as overcoats and interlayers, contain processing solution permeable vehicles and vehicle modifying addenda. Typically these layer or layers contain a hydrophilic colloid, such as gelatin or a gelatin derivative, modified by the addition of a hardener. Illustrations of these types of materials are contained in *Research Disclosure*, Item 36544, previously cited, Section II. Vehicles, vehicle extenders, vehicle-like addenda and vehicle related addenda. The overcoat and other layers of the photographic element can usefully include an ultraviolet absorber, as illustrated by *Research Disclosure*, Item 36544, Section VI. UV dyes/optical brighteners/luminescent dyes, paragraph (1). The overcoat, when present can usefully contain matting agents to reduce surface adhesion. Surfactants are commonly added to the coated layers to facilitate coating. Plasticizers and lubricants are commonly added to facilitate the physical handling properties of the photographic elements. Antistatic agents are commonly added to reduce electrostatic discharge. Illustrations of surfactants, plasticizers, lubricants and matting agents are contained in *Research Disclosure*, Item 36544, previously cited, Section IX. Coating physical property modifying addenda.

A specific preferred application of the invention is in the preparation of high bromide emulsions for use in medical diagnostic imaging radiographic elements, particularly elements that are sensitive to IR radiation. A number of varied photographic film constructions have been developed to satisfy the needs of medical diagnostic imaging. The common characteristics of these films is that they (1) produce viewable silver images having maximum densities of at least 3.0 and (2) are designed for rapid access processing.

Roentgen discovered X-radiation by the inadvertent exposure of a silver halide photographic element. The discovery led to medical diagnostic imaging. In 1913, the Eastman Kodak Company introduced its first product specifically intended to be exposed by X-radiation. Shortly thereafter it was discovered that the films could be more efficiently employed in combination with one or two intensifying screens. An intensifying screen is relied upon to capture an image pattern of the X-radiation and emit light that exposes the radiographic element. Elements that rely entirely on X-radiation absorption for image capture are referred to as direct radiographic elements, while those that rely on intensifying screen light emission, are referred to as indirect radiographic elements. Silver halide radiographic elements, particularly indirect radiographic elements, account for the overwhelming majority of medical diagnostic images.

In recent years, a number of alternative approaches to medical diagnostic imaging, particularly image acquisition, have become prominent. Medical diagnostic devices such as storage phosphor screens, CAT scanners, magnetic resonance imagers (MRI), and ultrasound imagers allow information to be obtained and stored in digital form. Although digitally stored images can be viewed and manipulated on a cathode ray tube (CRT) monitor, a hard copy of the image is almost always needed.

The most common approach for creating a hard copy of a digitally stored image is to expose a radiation-sensitive silver halide film through a series of laterally offset exposures using a laser, a light-emitting diode (LED) or a light bar (a linear series of independently addressable LED's). The image is recreated as a series of laterally offset pixels. Initially, the radiation-sensitive silver halide films were essentially the same films used for radiographic imaging, except that finer silver halide grains were substituted to minimize noise (granularity). The advantages of using modified radiographic films to provide a hard copy of the digitally stored image are that medical imaging centers are already equipped for rapid access processing of radiographic films and are familiar with their image characteristics.

Rapid access processing can be illustrated by reference to the Kodak X-OMAT 480 RA™ rapid access processor, which employs the following (reference) processing cycle: development 24 seconds at 35° C.; fixing 20 seconds at 35° C.; washing 20 seconds at 35° C.; drying 20 seconds at 65° C.; with up to 6 seconds being taken up in film transport between processing steps.

A typical developer employed in this processor exhibits the following composition:

hydroquinone 30 g 1-phenyl-3-pyrazolidone 1.5 g

KOH 21 g

NaHCO3 7.5 g

K2 SO3 44.2 g

Na2S2 O3 12.6 g

NaBr 35.0 g 5-methylbenzotriazole 0.06 g glutaraldehyde 4.9 g water to 1 liter at a pH 10.

A typical fixer employed in this processor exhibits the following composition:

Na2 S2 O3 in water at 60% of total weight in water 260.0 g

NaHSO3 180.0 g boric acid 25.0 g acetic acid 10.0 g water to 1 liter at a pH of 3.9–4.5.

Numerous variations of the reference processing cycle (including, shorter processing times and varied developer and fixer compositions) are known.

Rapid access processors are typically activated when an imagewise exposed element is introduced for processing. Silver halide grains in the element interrupt an infrared sensor beam in the wavelength range of from 850 to 1100 nm, typically generated by a photodiode. The silver halide grains reduce density of infrared radiation reaching a photosensor, telling the processor that an element has been introduced for processing and starting the rapid access processing cycle. Once silver halide grains have been developed, developed silver provides the optical density necessary to interact with the infrared sensors. When the processed element emerges from the processor, an infrared sensor placed near the exit of the processor receives an uninterrupted infrared beam and shuts down the processor until another element is introduced requiring processing.

The performance of radiographic films designed for such rapid access processing can be improved with advancements in the precipitation process of the invention used to manufacture high bromide silver halide cubical grain emulsions. Each emulsion layer unit of such films can contain one, two, three or more separate emulsion layers sensitized to the same regions of the spectrum. When more than one emulsion layer is present in the same emulsion layer unit, the emulsion layers typically differ in speed. Typically interlayers containing oxidized developing agent scavengers, such as ballasted hydroquinones or aminophenols, are interposed between the emulsion layer units to avoid color contamination. Ultraviolet absorbers are also commonly coated over the emulsion layer units or in the interlayers.

Silver halide emulsions satisfying the grain requirements described above can be present in any one or combination of emulsion layer units in a radiographic film element, wherein such emulsion layer units are employed in any convenient conventional sequence. The advantages of the current invention may be achieved by modifying any or all of the emulsion formulations of such conventional sequences to conform to the requirements set forth in the specification. The exact magnitude of the benefits achieved will, of course, depend on the exact details of the formulations involved but these will be readily apparent to the skilled practitioner. It is specifically contemplated, e.g., that the process of the invention will be useful in preparing highly cubic high bromide emulsions for use in radiographic photographic elements intended for rapid processing such as described in U.S. Pat. No. 5,089,379 and 5,981,161, the disclosures of which are incorporated by reference herein, in combination with the various specific useful iodide contents, sensitizing dyes, surface active agents, azaindene compound and dopants such as described therein.

The following examples illustrate the practice of this invention. They are not intended to be exhaustive of all possible variations of the invention. Parts and percentages are by weight unless otherwise specified.

EXAMPLES

Two silver bromide emulsions were prepared in which the variation made was in the silver addition rate for the shell portion of the silver halide grain.

Example 1

Two silver bromide emulsions were prepared in which the variation made was in the silver addition rate for the shell portion of the silver halide grain.

Emulsion 1.1 (Comparison)

To a reactor containing 5.7 kg of distilled water, 0.5 g of $(HOCH_2CH_2SCH_2)_2$ and 320 g of bone gelatin, were added 32 g of 3.0 M sodium bromide salt solution such that the mixture was maintained at a pBr of about 1.9 at approximately 65° C. Aqueous solutions of about 2.0 M silver nitrate and about 2.0 M sodium bromide were then added by conventional controlled double-jet addition at a constant silver nitrate flow rate of about 30 ml/min for about 2.5 minutes while maintaining pBr constant at about 1.9 and then the silver salt addition rate was accelerated over the next 18 minutes to 100 ml/min. The pBr was ramped with the accelerating silver salt flow to a value of 3.5. This is considered to be the core of the silver halide grain containing 21.5% of the total silver moles. During a subsequent balanced double jet addition, the silver salt addition rate was maintained over final 37 minutes at 100 ml/min to grow an exterior shell portion on the core (resulting in a total silver salt addition time of 57.5 minutes). At the completion of the silver salt addition, the temperature was adjusted to 40° C. The silver bromide emulsion grains thus prepared had an average ECD of 0.354 $\mu$m (cubic edge length of 0.319 $\mu$m).

Emulsion 1.2 (Invention)

An emulsion was grown with an identically formed core comprising 21.5% of total silver such as described as Emulsion 1.1. The grain shell comprising the final 78% of silver, however, was grown under a balanced double jet addition such that the silver salt addition rate was maintained over a 14 minute period at 275 ml/min (for a total silver salt addition time of 34.5 minutes). At the completion of the silver salt addition, the temperature was adjusted to 40° C. The silver bromide emulsion thus prepared had an ECD of 0.347 $\mu$m (cubic edge length of 0.313 $\mu$m).

Emulsions 1.1 and 1.2 were washed by the ultrafiltration method described in *Research Disclosure*, Vol. 131, March 1975, Item 13122, and photomicrographs of samples of the emulsions grains were analyzed. The results are summarized in Table 1:

TABLE 1

| Example | Exterior region (mole % of total Ag in grains) | Maximum $R_s$ during the growth of shell ($min^{-2}$) | Average Cubic Edge Length ($\mu$m) | Average Roundness Index, Q |
|---|---|---|---|---|
| Comparison Emulsion 1.1 | 78% | $0.6 \times 10^3$ | 0.319 | 0.40 |
| Invention Emulsion 1.2 | 78% | $3.8 \times 10^{-3}$ | 0.313 | 0.24 |

In addition to providing a more time efficient manufacturing process for the preparation of high bromide silver halide cubical grain emulsion, the above data demonstrates that the process of the invention can enable a significantly more cubic emulsion to be obtained. Samples of Emulsions 1.1 and 1.2 were also optimally sensitized by the addition of Aurate(3-), bis(monothiosulfato(2-)-O,S)-, trisodium, dihydrate, (T-4)- and heat ramped to 68° C., and photographic evaluation demonstrated Emulsion 1.2 prepared in accordance with the invention provided higher contrast, lower fog, and higher Dmax relative to the comparison Emulsion 1.1.

Example 2

Two additional silver bromide emulsions were prepared in which the variation made was in the silver addition rate for the shell portion of the silver halide grain, similarly as in Example 1, but for slightly larger emulsion grains.

Emulsion 2.1 (Comparison)

To a reactor containing 5.5 kg of distilled water, 0.7 g of $(HOCH_2CH_2SCH_2)_2$ and 320 g of bone gelatin, were added 9.0 g of 0.4 M potassium bromide salt solution such that the mixture was maintained at a pBr of about 3.2 at approximately 67° C. Aqueous solutions of about 2.0 M silver nitrate and about 2.0 M sodium bromide were then added by conventional controlled double jet addition at a constant silver nitrate flow rate of about 50 ml/min for about 2.5 minutes while maintaining pBr constant at about 3.2 and then the silver salt addition rate was accelerated over the next 11.7 minutes to 100 ml/min. After 0.3 l of the silver nitrate solution had been added, 14 g of a 0.008 M solution of $K_2IrCl_6$ was added in 0.75 min. The pBr was then ramped to a value of 3.8 over a period of 5.0 min at a silver nitrate flow of 100 ml/min. This is considered to be the core of the silver halide grain containing 30% of the total silver moles. During a subsequent balanced double jet addition, the silver salt addition rate was maintained over a 35 min period at 100 ml/min to grow an exterior shell portion on the core (resulting in a total silver salt addition time of 54 minutes). At the completion of the silver salt addition, the temperature was adjusted to 40° C. The silver bromide emulsion grains thus prepared had an average ECD of 0.390 $\mu$m (cubic edge length of 0.349 $\mu$m).

Emulsion 2.2 (Invention)

An emulsion was grown with an identically formed core comprising 30% of total silver such as described as Emulsion 2.1. The grain shell comprising the final 70% of silver, however, was grown under a balanced double jet addition such that the silver salt addition rate was maintained over a 12.8 minute period at 275 ml/min (for a total silver salt addition time of 32 minutes). At the completion of the silver salt addition, the temperature was adjusted to 40° C. The silver bromide emulsion thus prepared had an ECD of 0.397 $\mu$m (cubic edge length of 0.353 $\mu$m).

Emulsions 2.1 and 2.2 were washed by the ultrafiltration method described in *Research Disclosure*, Vol. 131, March 1975, Item 13122, and photomicrographs of samples of the emulsions grains were analyzed. The results are summarized in Table 2:

TABLE 2

| Example | Exterior region (mole % of total Ag in grains) | Maximum $R_s$ during the growth of shell ($min^{-2}$) | Average Cubic Edge Length ($\mu$m) | Average Roundness Index, Q |
|---|---|---|---|---|
| Comparison Emulsion 2.1 | 70% | $0.6 \times 10^{-3}$ | 0.349 | 0.39 |
| Invention Emulsion 2.2 | 70% | $4.3 \times 10^{-3}$ | 0.353 | 0.32 |

As in Example 1, in addition to providing a more time efficient manufacturing process for the preparation of high bromide silver halide cubical grain emulsion, the above data demonstrates that the process of the invention can enable a more cubic emulsion to be obtained, although the change in Roundness Index is not quite as large as in Example 1.

The invention has been described in detail with particular reference to preferred embodiments thereof, but it will be understood that variations and modifications can be effected within the spirit and scope of the invention.

What is claimed is:

1. A process for the preparation of a radiation-sensitive silver halide emulsion comprised of high bromide cubical silver halide grains, the process comprising:

(a) providing in a stirred reaction vessel a dispersing medium and high bromide silver halide seed grains, the seed grains comprising at least 5 mole % of the final emulsion silver, and (b) precipitating a silver halide shell which comprises at least 5 mole % of the final emulsion silver onto the seed grains to form high bromide cubical silver halide grains by introducing at least a silver salt solution into the dispersing medium at a rate such that the normalized shell molar addition rate, $R_s$, is above $1.0\times10^{-2}$, $R_s$ satisfying the formula:

$$R_s = \frac{M_s}{M_t t_s^2}$$

where $M_s$ is the number of moles of silver halides added to the reaction vessel during the formation of the shell, $t_s$ is the run time, in minutes, of the silver salt solution for the formation of the shell, and $M_t$ is total moles of silver halide in the reaction vessel at the end of the precipitation of the shell;

wherein the concentration of silver halide grains in the reaction vessel at the end of the precipitation of the shell is at least 0.5 mole/L.

2. The process according to claim 1, wherein in step (b) a halide salt solution is simultaneously introducing into the dispersing medium with the silver salt solution.

3. The process according to claim 1, wherein the concentration of silver halide grains in the reaction vessel at the end of the precipitation of the shell is at least 0.8 mole/L.

4. The process according to claim 1, wherein the concentration of silver halide grains in the reaction vessel at the end of the precipitation of the shell is at least 1.0 mole/L.

5. The process according to claim 1 wherein R, is above $2.0\times10^{-3}$ $min^{-2}$ in step (b).

6. The process according to claim 1, wherein the seed grains provided in step (a) comprise at least 10 mole % of the final emulsion silver.

7. The process according to claim 6, wherein the seed grains provided in step (a) comprise at least 15 mole % of the final emulsion silver.

8. The process according to claim 1 wherein the silver halide shell precipitated during step (b) comprises at least 10 mole % of the final emulsion silver.

9. The process according to claim 8 wherein the silver halide shell precipitated during step (b) comprises at least 20 mole % of the final emulsion silver.

10. The process according to claim 9 wherein the silver halide shell precipitated during step (b) comprises at least 30 mole % of the final emulsion silver.

11. The process according to claim 10 wherein the silver halide shell precipitated during step (b) comprises at least 40 mole % of the final emulsion silver.

12. The process according to claim 11 wherein the silver halide shell precipitated during step (b) comprises greater than 50 mole % of the final emulsion silver.

13. The process according to claim 1 wherein the high bromide cubical silver halide grains contain at least 70 mole percent bromide, based on silver.

14. The process according to claim 1 wherein the high bromide cubical silver halide grains contain at least 90 mole percent bromide, based on silver.

15. The process according to claim 1, wherein high bromide cubic silver halide grains are formed.

16. The process according to claim 15, wherein the high bromide cubic grains have an average cubic edge length of less than 0.4 micrometers and an average roundness index Q of less than 0.35.

17. The process according to claim 16, wherein the high bromide cubic grains have an average cubic edge length of less than or equal to 0.35 micrometers and an average roundness index Q of less than or equal to 0.32.

18. The process according to claim 17, wherein the high bromide cubic grains have an average cubic edge length of less than or equal to 0.33 micrometers and an average roundness index Q of less than or equal to 0.30.

19. A radiation sensitive silver halide emulsion prepared by the process of claim 1 comprising high bromide cubic grains have an average cubic edge length of less than 0.4 micrometers and an average roundness index Q of less than 0.35.

20. A radiation sensitive silver halide emulsion prepared by the process of claim 1 comprising high bromide cubic grains have an average cubic edge length of less than or equal to 0.33 micrometers and an average roundness index Q of less than or equal to 0.30.

* * * * *

UNITED STATES PATENT AND TRADEMARK OFFICE

CERTIFICATE OF CORRECTION

PATENT NO. : 6,753,134 B2
DATED : June 22, 2004
INVENTOR(S) : Dirk J. Hasberg et al.

It is certified that error appears in the above-identified patent and that said Letters Patent is hereby corrected as shown below:

Column 14,
Line 38, after the word "above" delete "$1.0x10^{-2}$" and insert -- $1.0x10^{-3}$min.$^{-2}$ --.

Signed and Sealed this

Sixth Day of December, 2005

JON W. DUDAS
*Director of the United States Patent and Trademark Office*